US007175458B2

(12) United States Patent
Tsai

(10) Patent No.: US 7,175,458 B2
(45) Date of Patent: Feb. 13, 2007

(54) ELECTRICAL CONNECTOR HAVING A FLEXIBLE CIRCUIT INTERFACE

(76) Inventor: Chou Hsuan Tsai, 15F,No. 4, Lane 127, Sec. 1, Fu-Hsing Rd., Hsin-Chuang City, Taipei Hsien (TW)

( * ) Notice: Subject to any disclaimer, the term of this patent is extended or adjusted under 35 U.S.C. 154(b) by 0 days.

(21) Appl. No.: 11/408,482

(22) Filed: Apr. 20, 2006

(65) Prior Publication Data

US 2006/0246759 A1 Nov. 2, 2006

(51) Int. Cl.
*H01R 13/15* (2006.01)

(52) U.S. Cl. ..... 439/260; 439/495

(58) Field of Classification Search ..... 439/260, 439/495

See application file for complete search history.

(56) References Cited

U.S. PATENT DOCUMENTS 4,944,690 A * 7/1990 Imai ..... 439/492
5,695,359 A * 12/1997 Fujikura et al. ..... 439/495
6,203,345 B1 * 3/2001 Roque et al. ..... 439/260
6,254,406 B1 * 7/2001 Chiu et al. ..... 439/495
6,283,779 B1 * 9/2001 Lung ..... 439/260

* cited by examiner

*Primary Examiner*—Tho D. Ta
(74) *Attorney, Agent, or Firm*—Pro-Techtor Int'l Services

(57) ABSTRACT

An electrical connector includes a base, terminals and a cover. The base is formed with terminal slots for receiving the terminals, and one connection portion having an open end into which a flexible circuit interface may be inserted. A pushing plate is formed above the connection portion. A first elastic arm is formed with a connection point extending to the connection portion. The terminals are electrically connected to the inserted interface. The metal cover has a handle and a pressing plate. Two sides of the cover are formed with projecting pivoting portions pivoting onto two sides of the connection portion. The pressing plate may extend into the connection portion to tightly press against the pushing plate and the interface when the cover is rotated downwards. The pressing plate is exposed out of the connection portion to make the pushing plate and the interface loose when the cover is lifted upwards.

23 Claims, 18 Drawing Sheets

ELECTRICAL CONNECTOR HAVING A FLEXIBLE CIRCUIT INTERFACE

BACKGROUND OF THE INVENTION

1. Field of the Invention

The invention relates to an electrical connector, and more particularly to an electrical connector having a flexible circuit interface.

2. Description of the Related Art

Referring to FIGS. 1 and 2, a conventional electrical connector with a flexible circuit interface may be connected to a flexible circuit board or a flexible cable and includes a base 10, a plurality of terminals 16 and a cover 23. The base 10 is divided into a plurality of terminal slots 12 and a connection portion 13 by baffles 11. The terminal 16 has a pin portion 17, a first elastic arm 18 and a second elastic arm 19. The first elastic arm 18 has a connection point 20 extending to the connection portion 13. The second elastic arm 19 is formed with a recess 21 at a distal end thereof. The cover 23 is formed with openings 24 and pressing sheets 25 corresponding to the terminals 16. The second elastic arm 19 of each terminal 16 passes through the opening 24 of the cover 23 such that the pressing sheet 25 is hooked by the recess 21. Consequently, when the cover 23 is rotated downwards, the pressing sheet 25 can vertically and tightly press against the inserted flexible circuit interface.

The prior art has the following drawbacks.

1. The cover 23 is formed with the openings 24 corresponding to the terminals, so the precision in manufacturing is very high, and the cover cannot be easily manufactured.

2. The second elastic arm 19 of the terminal 16 directly presses against the cover 23, so the cover 23 cannot be made of a metal material and the intensity thereof is not very high. If the cover 23 is made of the metal material, the cover is electrically connected to the second elastic arms 19 of the terminals and is thus short-circuited.

3. If the cover 23 is made of a plastic material, the thickness thereof should be increased. Thus, the space in the base 10 is reduced, and the structure intensity is weakened.

SUMMARY OF THE INVENTION

It is therefore an object of the invention to provide an electrical connector having a flexible circuit interface and a cover made of a metal material, such that the intensity of the cover is high and the structure can be manufactured easily.

Another object of the invention is to provide an electrical connector having a flexible circuit interface, wherein a pushing plate is disposed above a connection portion of a base, an eccentric plate extending into the connection portion of the base is formed on a cover, and the eccentric plate engages with and pivots onto the pushing plate of the base.

Still another object of the invention is to provide an electrical connector having a flexible circuit interface and a cover formed by pressing and bending a metal plate, wherein the surface of the metal plate is pressed into pivoting recesses, each of which has a circular arc surface with an arc angle larger than 180 degrees, at two sides of the cover, the pivoting recesses pivot to pivots at two sides of the base, and the circular arc surface of the pivoting recess covers the pivot such that the pivoting is stabilized.

To achieve the above-identified objects, the invention provides an electrical connector including a base, a plurality of terminals and a cover. The base is formed with a plurality of equally spaced terminal slots and one connection portion. The connection portion has an open end into which a flexible circuit interface may be inserted. A pushing plate is formed above the connection portion. The terminals are disposed in the terminal slots of the base. Each of the terminals has a pin portion extending out of the base. A positioning portion tightly presses against the terminal slot of the base. A first elastic arm is formed with a connection point extending to the connection portion of the base. The terminals are to be electrically connected to the inserted flexible circuit interface. The cover is made of a metal material and has a handle and a pressing plate. Two sides of the cover are formed with projecting pivoting portions pivoting onto two sides of the connection portion of the base. The pressing plate may extend into the connection portion to tightly press against and be located between the pushing plate and the flexible circuit interface when the cover is rotated downwards. The pressing plate is exposed out of the connection portion to make the pushing plate and the flexible circuit interface loose when the cover is lifted upwards.

Other objects, features, and advantages of the invention will become apparent from the following detailed description of the preferred but non-limiting embodiments. The following description is made with reference to the accompanying drawings.

DETAILED DESCRIPTION OF THE INVENTION

Figures 1, 2:
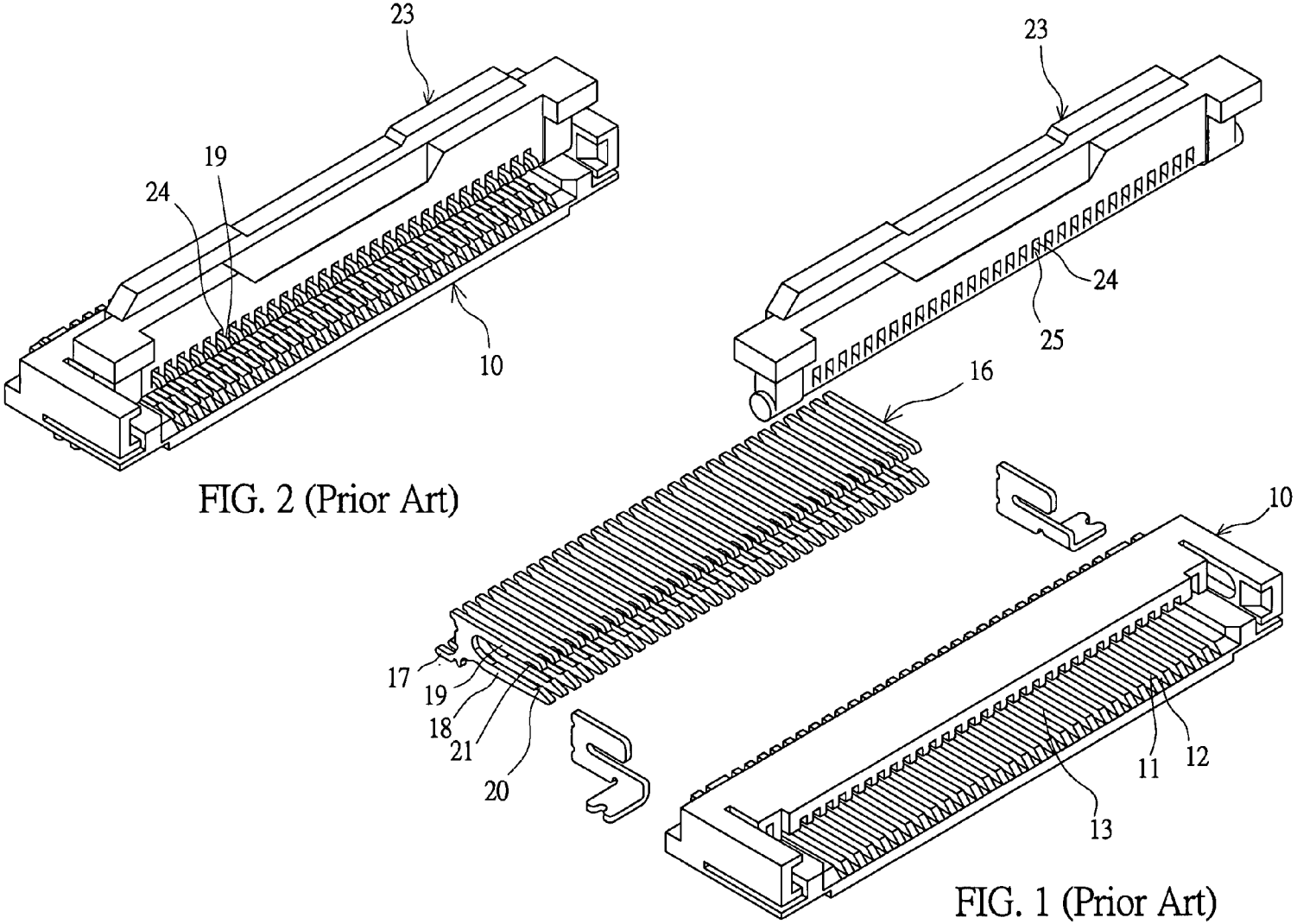
FIG. 1 (Prior Art)
FIG. 2 (Prior Art)
FIG. 1 is a pictorially exploded view showing an electrical connector with a flexible circuit interface according to the prior art.
FIG. 2 is a pictorially assembled view showing the electrical connector with the flexible circuit interface according to the prior art.
Figures 3, 4:
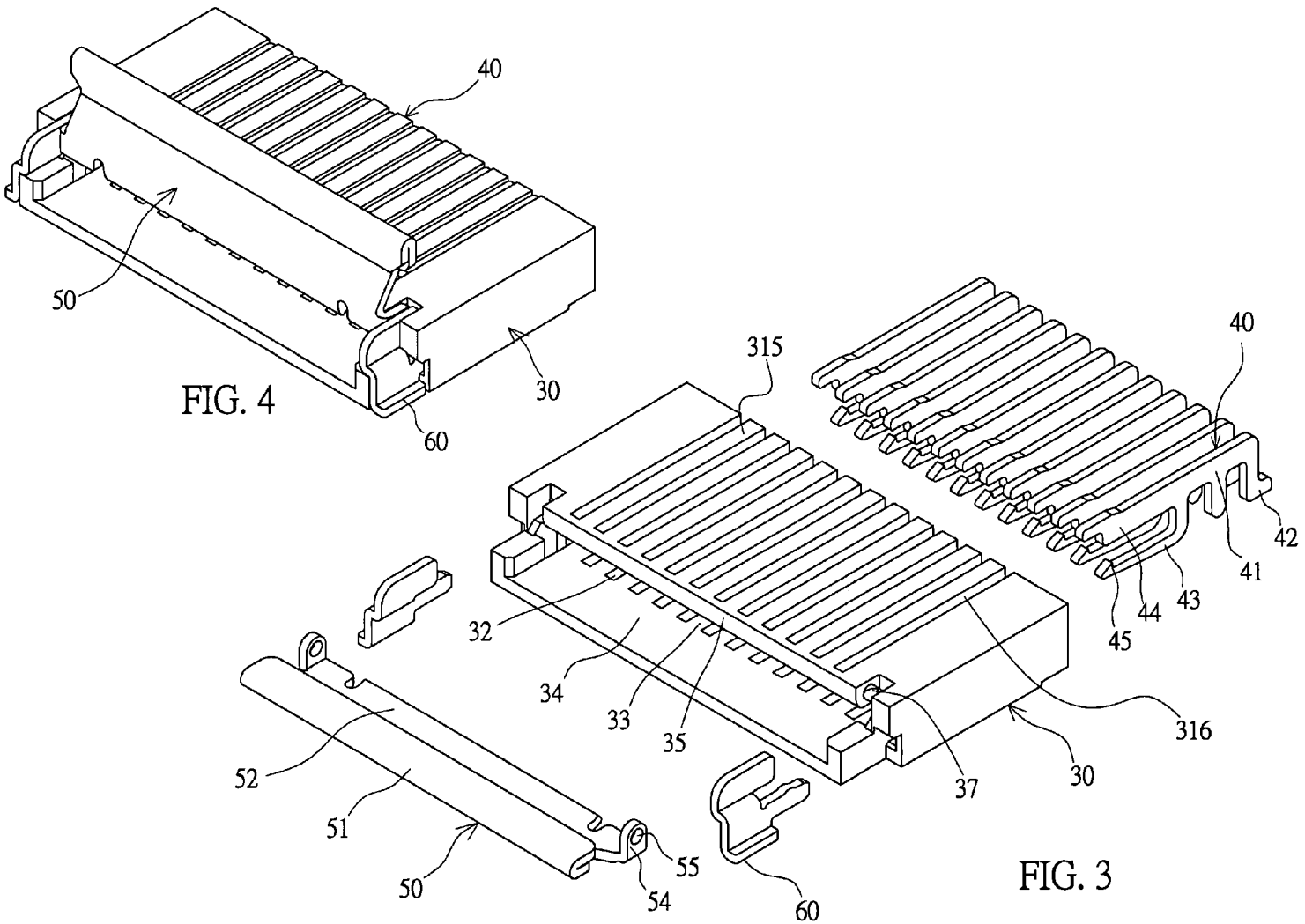
FIG. 3 is a pictorially exploded view showing an electrical connector according to a first embodiment of the invention.
FIG. 4 is a pictorially assembled view showing the electrical connector according to the first embodiment of the invention.
Figure 5:
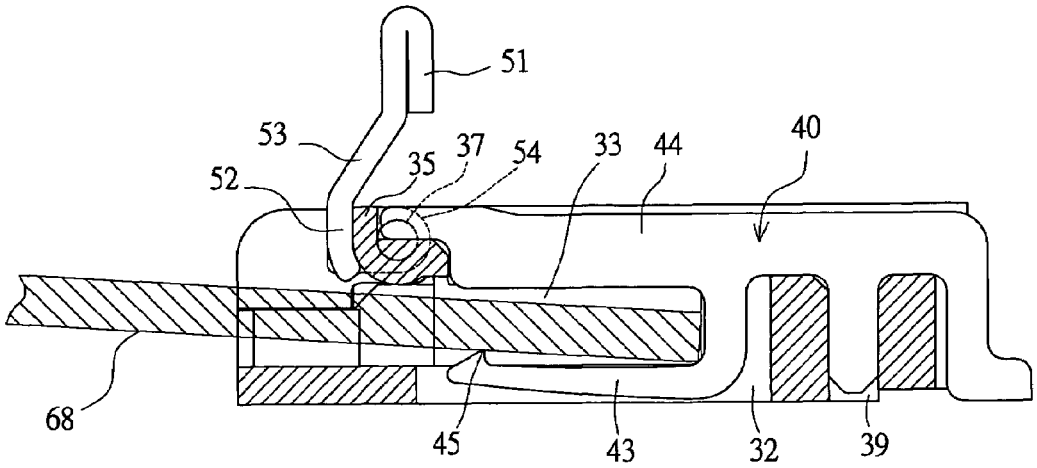
FIGS. 5 to 8 are cross-sectional side views showing usage states of the connector according to the first embodiment of the invention.

Referring to FIGS. 3 to 5, the connector according to the first embodiment of the invention includes a base 30, a plurality of terminals 40, a cover 50 and two bonding pads 60.

The base 30 is made of a plastic material and is formed with a plurality of equally spaced terminal slots 32 and a connection portion 33. The front end of the base is an inserting port 34 of the connection portion 33, into which a flexible circuit interface (e.g., a flexible circuit board or a flexible cable) may be inserted from a front side to a back side. A pushing plate 35 having a circular arc surface is disposed above the front end of the connection portion 33. Two sides of the connection portion 33 of the pushing plate 35 are formed with pivots 37. The circular arc surface of the pushing plate 35 is concentric with the pivots 37. In addition, each terminal slot 32 is formed with an engaging slot 39. Spaced open slots 316 corresponding to the terminal slots are formed on a top plate surface 315 of the base in back of the pushing plate 35 such that the terminals pass through the open slots 316 as they are assembled in the base.

The terminals 40 are inserted into the terminal slots 32 through the open slots 316 of the base 30. Each terminal 40 is integrally formed with a positioning portion 41, a pin portion 42, a first elastic arm 43 and a second elastic arm 44. The T-shaped positioning portion 41 is inserted into the engaging slot 39 of the terminal slot 32 for positioning. The pin portion 42 is connected to the rear end of the positioning portion 41 and extends out of the base 30. The first elastic arm 43 is connected to a front end of the positioning portion 41. The front end of the first elastic arm 43 is formed with a connection point 45 extending to the connection portion 33 of the base. The second elastic arm 44 is connected to the front end of the positioning portion 41 and located above the first elastic arm 43. The front end of the second elastic arm 44 presses the pushing plate 35 of the base 30 in the direction to the flexible circuit interface 68.

The cover 50 is formed by bending and pressing a metal plate and is formed with a handle 51 and a pressing plate 52. An inclined extending plate 53 is disposed between the handle 51 and the pressing plate 52. The tail end of the pressing plate 52 slightly extends upwards and two sides of the pressing plate 52 are bent into pivoting portions extending upwards. The pivoting portion is a pivoting lug 54 formed with a pivoting hole 55 pivoting onto the pivot 37 at each of the two sides of the pushing plate of the base. The pivoting hole 55 and the pressing plate 52 has a height difference, and the handle 51 is formed by folding back the metal plate.

The two bonding pads 60 are assembled at two sides of the base 30 and are disposed at outer sides of the pivots 37 to avoid the detachment of the cover 50.

Figure 6:
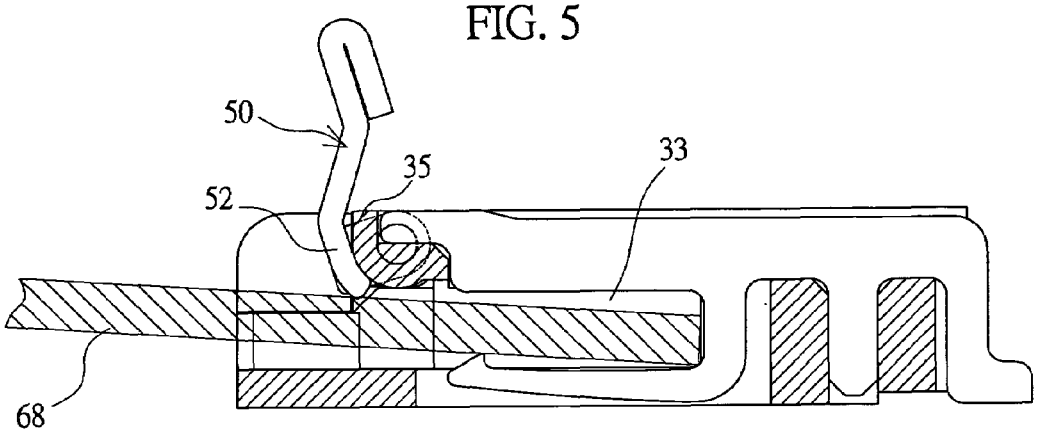
Figure 7:
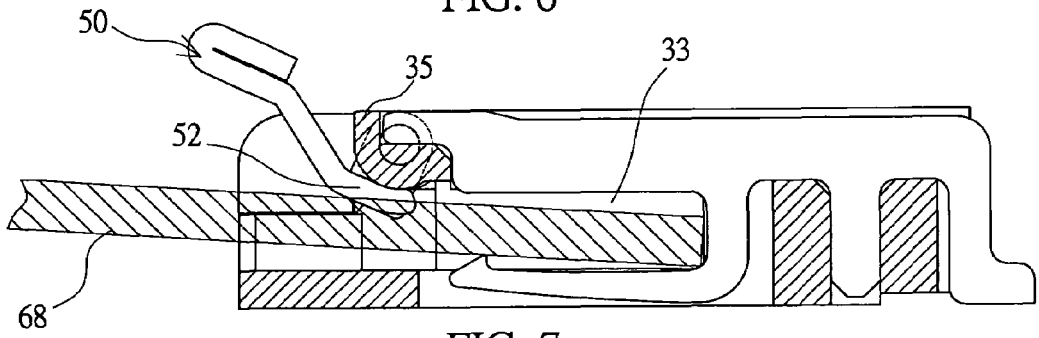
Figure 8:
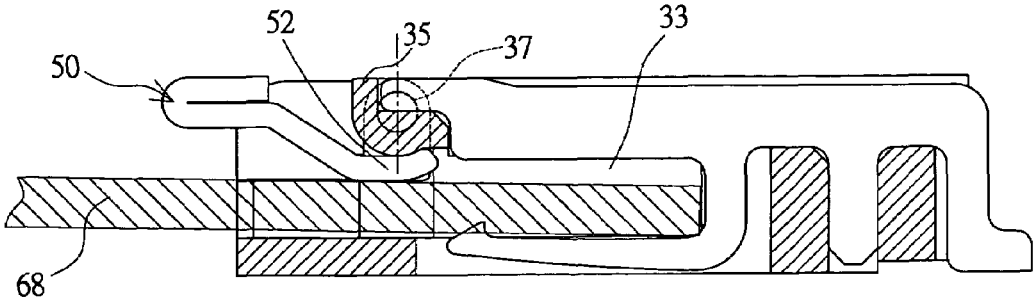

According to the above-mentioned structure, as shown in FIG. 5, when the cover 50 is lifted upwards, the pressing plate 52 is moved upwards and is exposed out of the connection portion 33, and rests against the circular arc surface of the pushing plate such that the insert flexible circuit interface 68 may be loosened. As shown in FIGS. 6 and 7, when the cover 50 is rotated downwards to a closed state, the pressing plate 52 of the cover 50 rests against the circular arc surface of the pushing plate 35 to slide into the connection portion 33. As shown in FIG. 8, when the cover 50 is moved downwards to a positioning location, the pressing plate 52 tightly presses against and is located between the pushing plate 35 and the flexible circuit interface 68. The tail end of the pressing plate 52 has exceeded the vertical line passing through a center of the pivot 37. The pushing plate 35 is in front of the connection points 45 of the terminals 40. The pushing plate 35 pushes the cover 50 in a direction to the flexible circuit interface 68.

The first embodiment has the following advantages.

First, the cover has a simple structure and can be manufactured easily.

Second, the pushing plate 35 of the base can separate the cover 50 from the second elastic arm 44 of the terminal 40. So, the cover 50 can be made of the metal material to enhance the structure intensity.

Third, the thickness of the metal cover 50 may be smaller than that of the plastic cover. So, the thickness of the plastic base 30 may be increased to enhance the structure intensity.

Figure 9A:
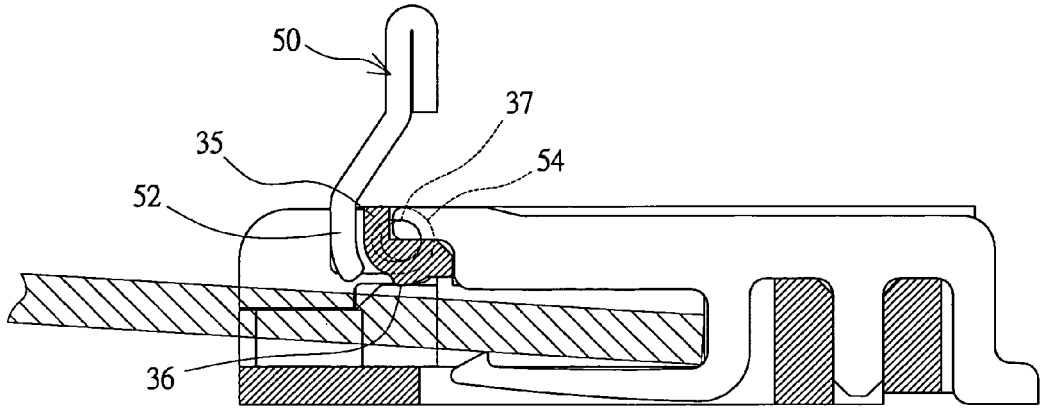
FIGS. 9*a* to 9*d* are cross-sectional side views showing usage states of a connector according to a second embodiment of the invention.
Figure 9B:
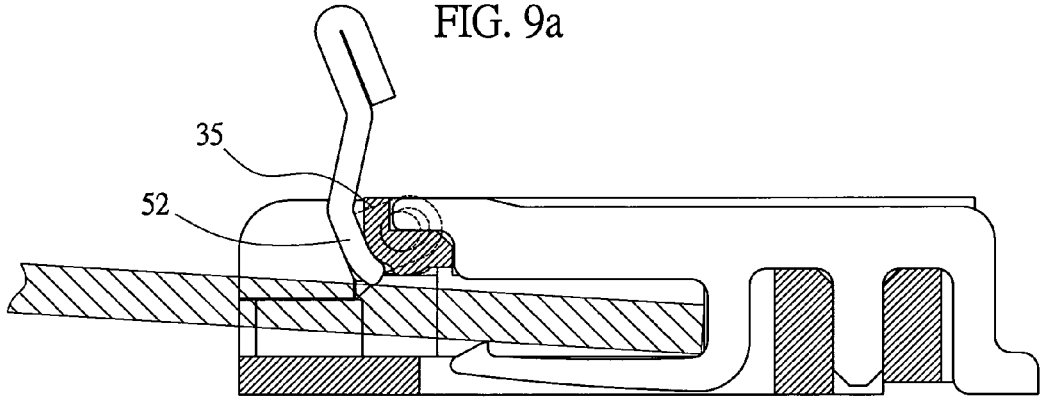
Figure 9C:
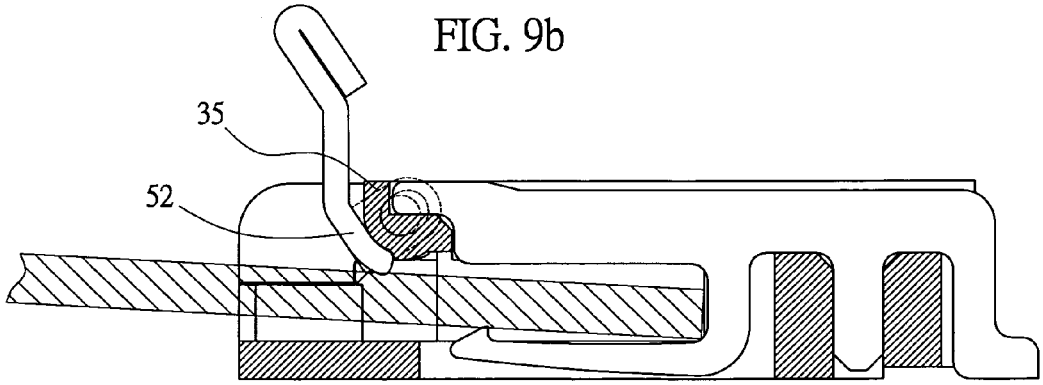
Figure 9D:
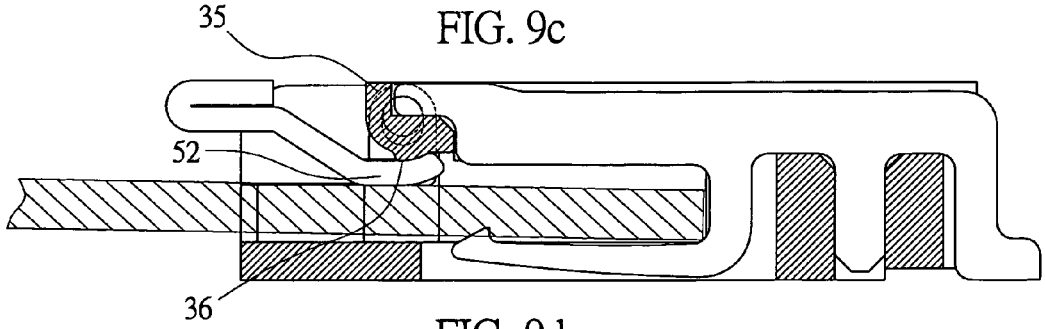
Figure 10A:
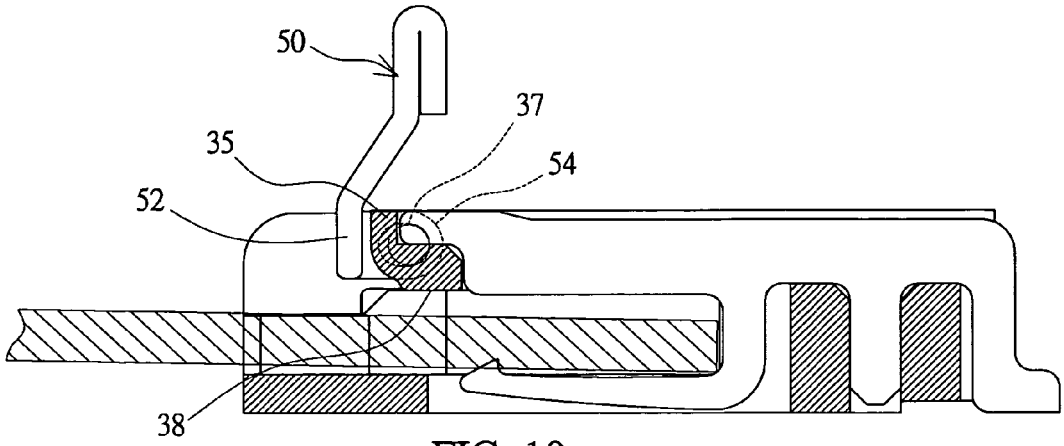
FIGS. 10*a* to 10*d* are cross-sectional side views showing usage states of a connector according to a third embodiment of the invention.
Figure 10B:
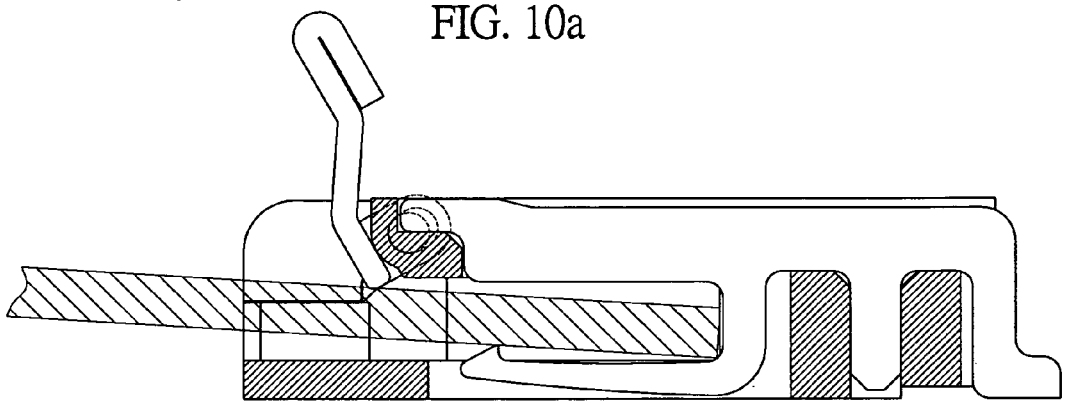
Figure 10C:
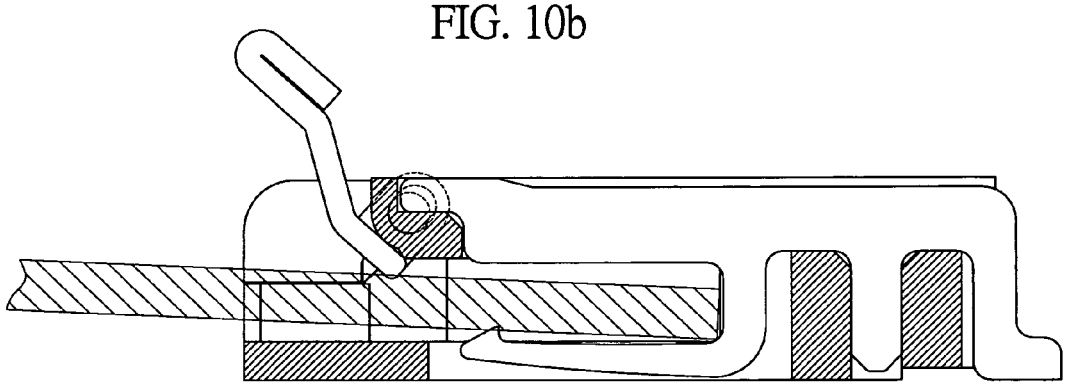
Figure 10D:
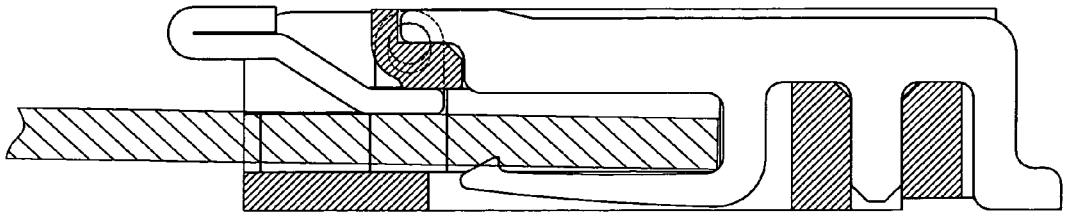

As shown in FIGS. 9*a* to 9*d*, the second embodiment is almost the same as the first embodiment except that the pressing plate 52 is moved upwards but does not rest against the circular arc surface of the pushing plate 35 when the cover 50 is lifted upwards in the second embodiment. Thus, a gap exists between the pressing plate 52 and the pushing plate 35. Consequently, when the cover 50 is rotated downwards to a closed state, as shown in FIG. 9*b*, the pressing plate 52 cannot press the pushing plate 35 when it is located at the lateral side. As shown in FIG. 9*c*, the pressing plate 52 has pressed the pushing plate 35. As shown in FIG. 9*d*, the pressing plate 52 is rotated to position and press a projecting point 36 of the pushing plate 35.

As shown in FIGS. 10*a* to 10*d*, the third embodiment is almost the same as the second embodiment except that the tail end of the pressing plate 52 of the cover 50 has a flat surface in the third embodiment, and the bottom of the pushing plate 35 extends inwards to exceed a vertical line passing through a center of the pivot 37 to form a convex surface 38.

Figure 11A:
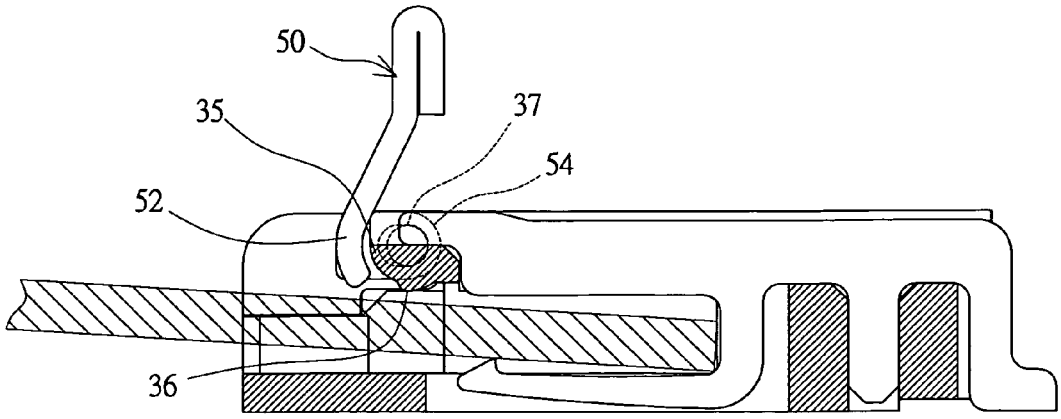
FIGS. 11*a* to 11*d* are cross-sectional side views showing usage states of a connector according to a fourth embodiment of the invention.
Figure 11B:
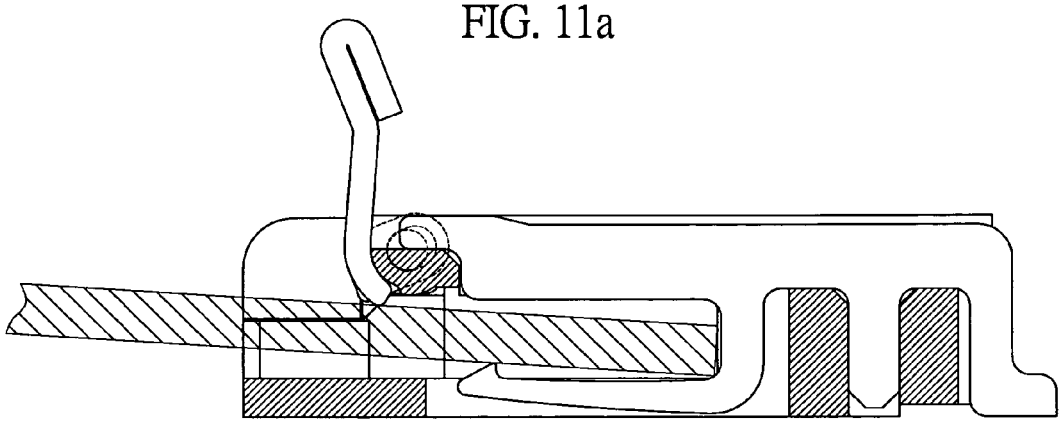
Figure 11C:
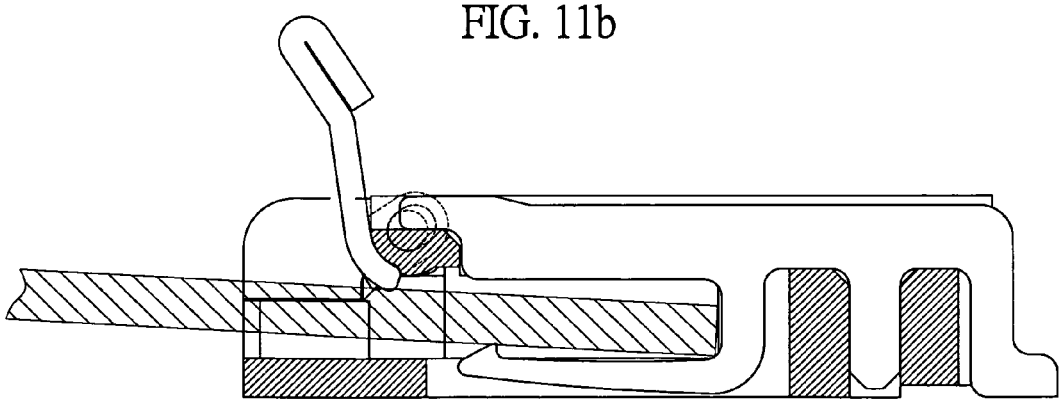
Figure 11D:
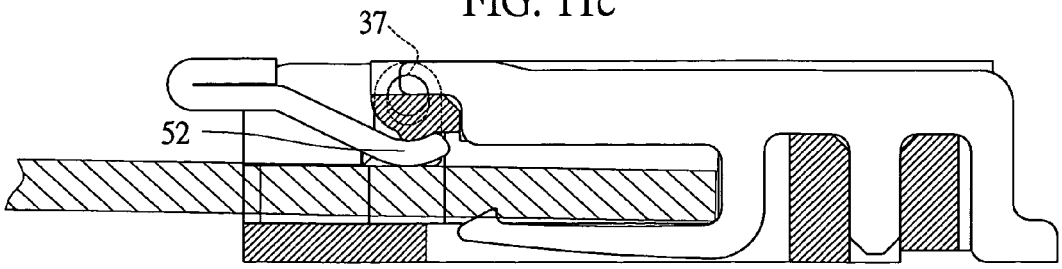

As shown in FIG. 11*a* to 11*d*, the fourth embodiment is almost the same as the second embodiment except that the angle between the pressing plate 52 of the cover 50 and the pivoting lug 54 is smaller than 90 degrees in the fourth embodiment. Thus, as shown in FIG. 11*d*, the pressing plate 52 has exceeded the vertical line passing through the center of the pivot 37 such that the cover 50 may be positioned firmly without extending upwards.

Figures 12, 13:
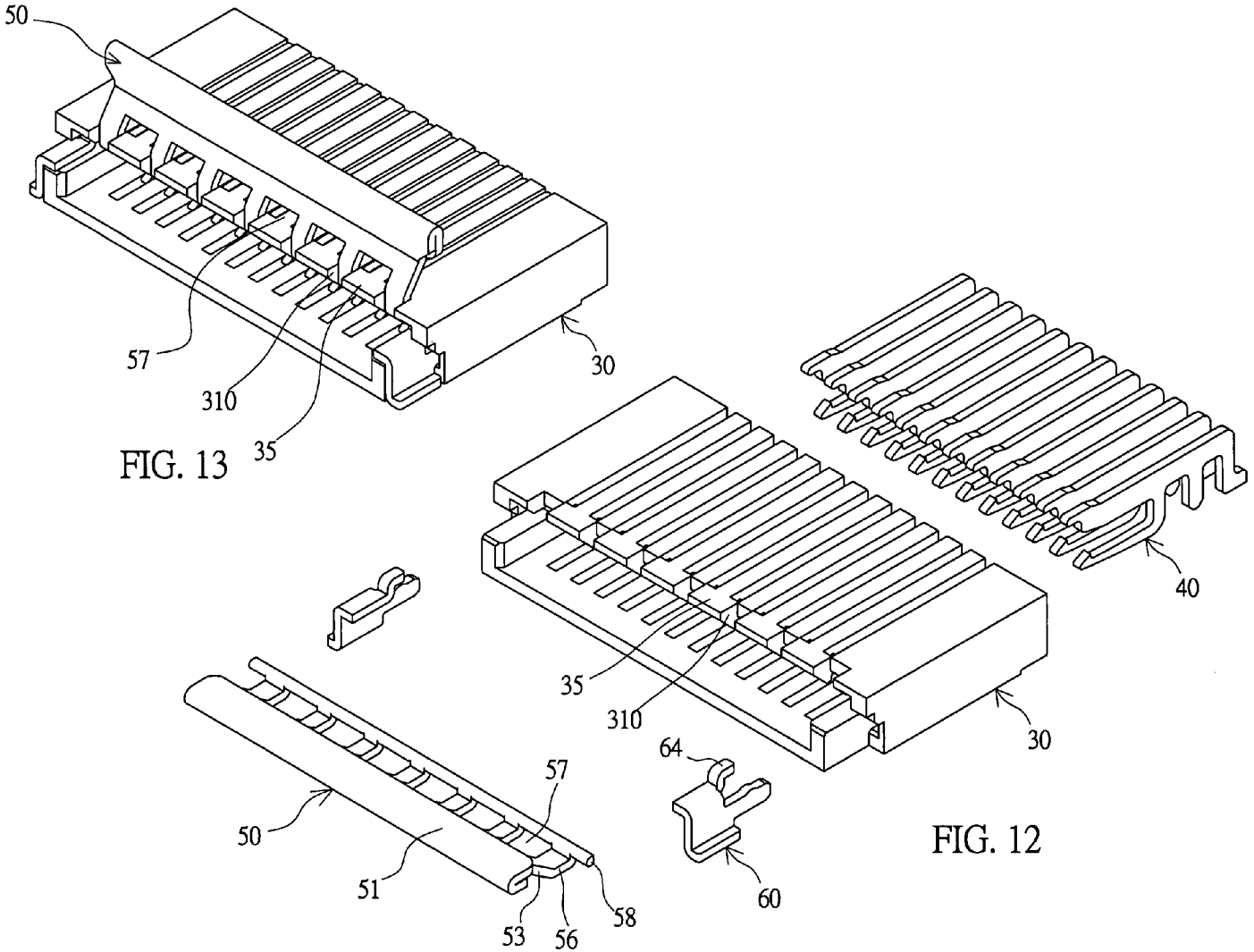
FIG. 12 is a pictorially exploded view showing an electrical connector according to a fifth embodiment of the invention.
FIG. 13 is a pictorially assembled view showing the electrical connector according to the fifth embodiment of the invention.
Figure 14:
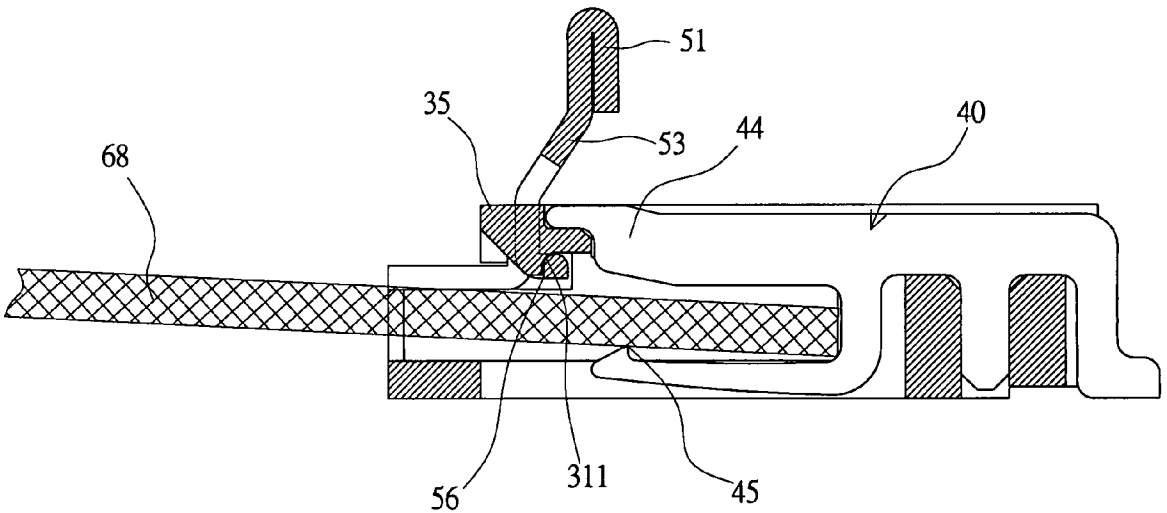
FIGS. 14 and 15 are cross-sectional side views showing usage states of the connector according to the fifth embodiment of the invention.

As shown in FIGS. 12 to 14, the fifth embodiment of the invention is almost the same as the first embodiment except that a notch 310 is formed on the pushing plate 35 of the base 30 every two gaps between the terminal slots, and the inner surface thereof has a pivoting slot 311 having an arc angle of about 90 degrees. One end of the cover 50 is formed with a handle 51 and the other end of the cover is formed with an L-shaped eccentric plate 56 extending to a location under the pushing plate 35 when the cover 50 is rotated downwards. The eccentric plate 56 can engage with and pivot onto the pivoting slot 311 of the pushing plate 35 of the base 30. Pivots 58 are extended from two sides of the eccentric plate 56. An inclined extending plate 53 is disposed between the handle 51 and the eccentric plate 56. An opening 57 is formed on one end of the eccentric plate every two gaps between the terminal slots. The openings 57 of the cover and the notches 310 of the base are staggered such that the cover 50 can be rotated relative to the base 30. The bonding pads 60 are fixed at two sides of the base and are formed with resting plates 64 resting against the pivots 58 of the cover.

Figure 15:
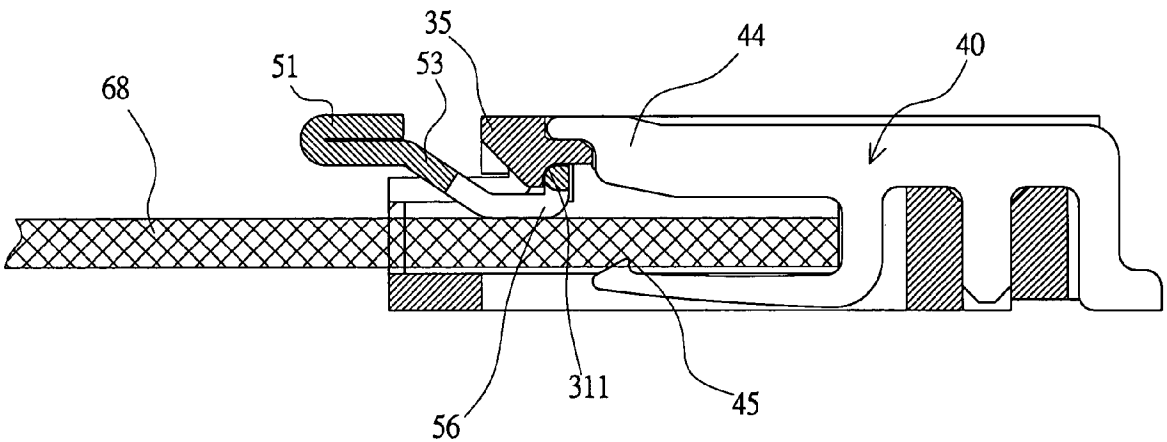

As shown in FIG. 14, when the cover 50 is rotated upwards, the L-shaped eccentric plate 56 is rotated by 90 degrees such that the plate 56 is lifted up by a height. At this time, the flexible circuit interface 68 may be inserted in a loose state. As shown in FIG. 15, when the cover 50 is rotated downwards, the eccentric plate 56 is rotated back by 90 degrees and is lowered by a height. So, the eccentric plate 56 of the cover 50, which is pressed down by the pushing plate 35, tightly presses against the flexible circuit interface 68 and is electrically connected to the connection points 45 of the terminals 40.

In the structure of this embodiment, the second elastic arm 44 of the terminal 40 presses the pushing plate 35 of the base 30 and the pivots 58 at the two sides of the cover 50 are pressed by the resting plates 64 of the bonding pads 60. So, the cover 50 is well supported. If the cover 50 is made of the plastic material such that the structure intensity thereof is weaker than that made of the metal material, the plastic cover still can withstand the reaction force of pressing the flexible circuit interface 68.

Figure 16:
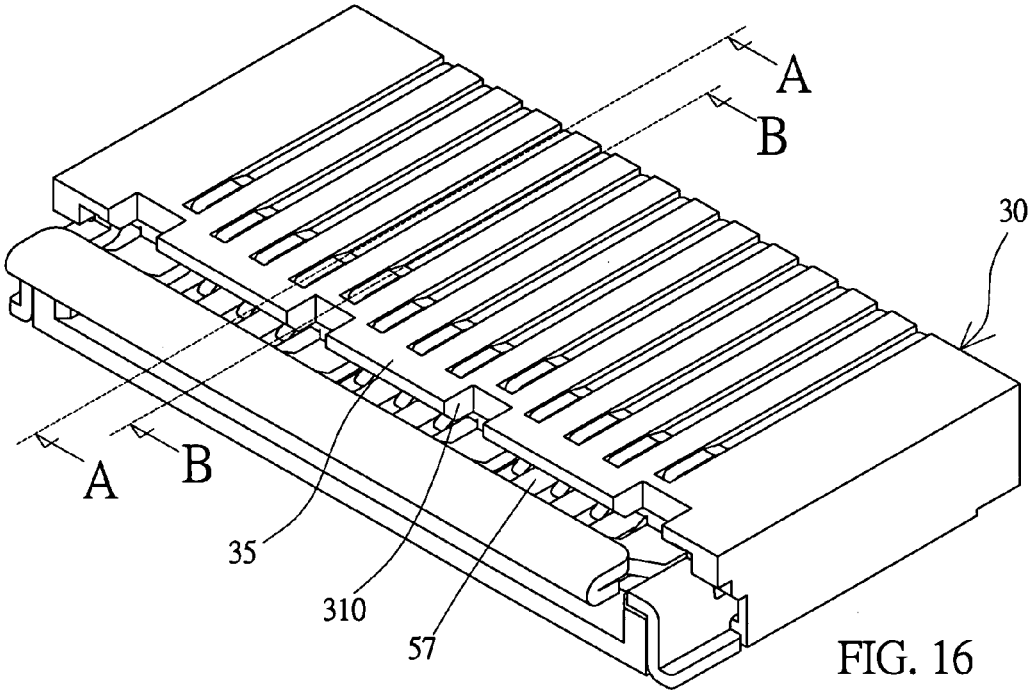
FIGS. 16 is a pictorially exploded view showing an electrical connector according to a sixth embodiment of the invention.
Figure 17:
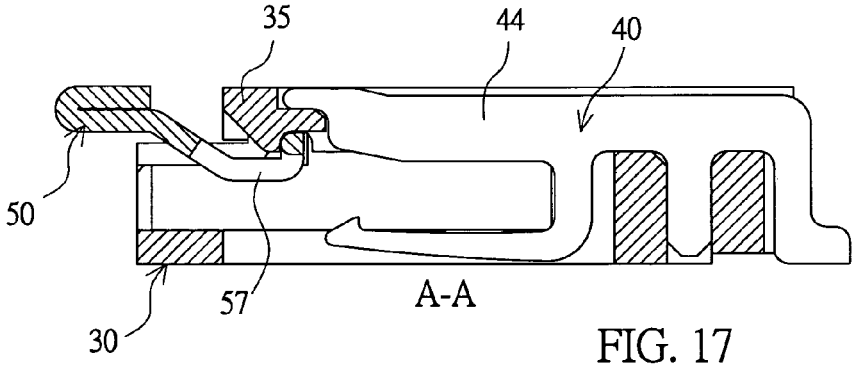
FIGS. 17 and 18 are cross-sectional side views showing the connector according to the sixth embodiment of the invention.
Figure 18:
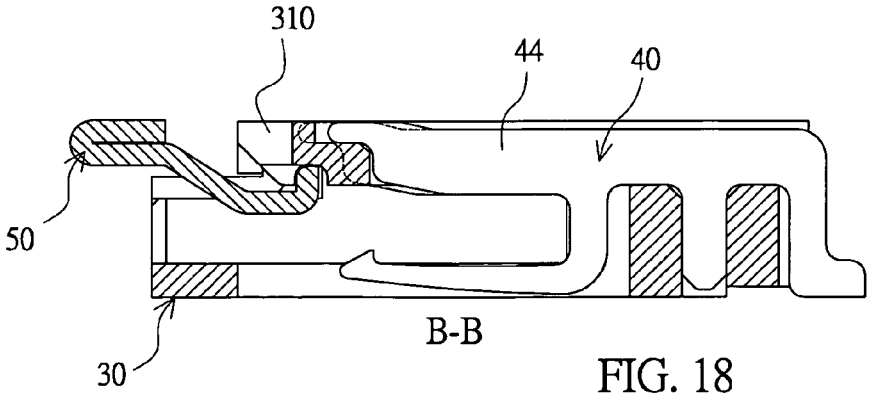

As shown in FIGS. 16 to 18, the sixth embodiment is almost the same as the fifth embodiment except that the pushing plate 35 of the base 30 is formed with a notch 310 every three gaps between the terminal slots. Thus, the second elastic arms 44 of the terminal 40 include a short arm and three long arms. The second elastic arm 44 of FIG. 17 is a long arm, and the second elastic arm 44 of FIG. 18 is a short arm. Similarly, the openings 57 of the cover 50 and the notches 310 are staggered.

Figure 19:
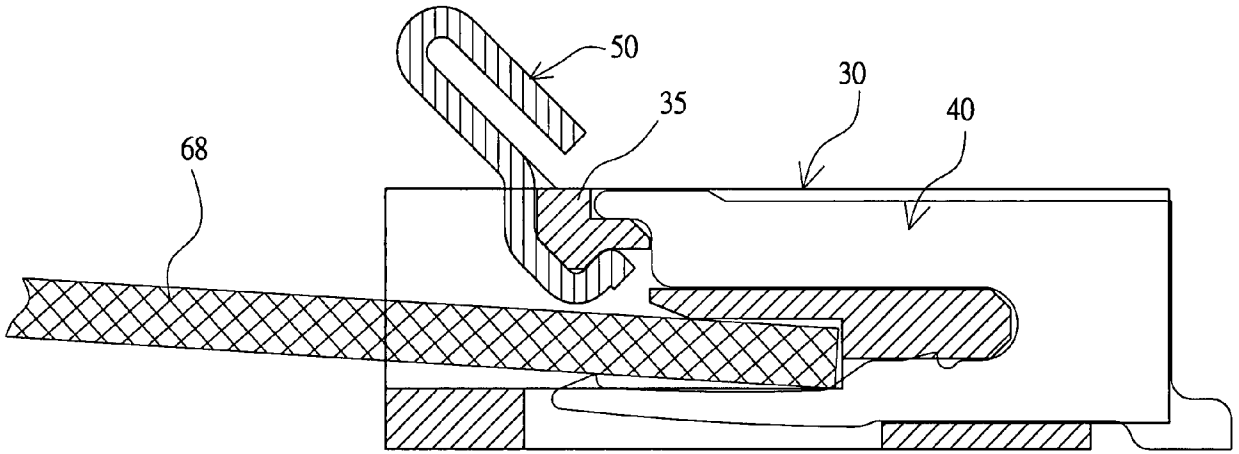
FIGS. 19 and 20 are cross-sectional side views showing usage states of a connector according to a seventh embodiment of the invention.
Figure 20:
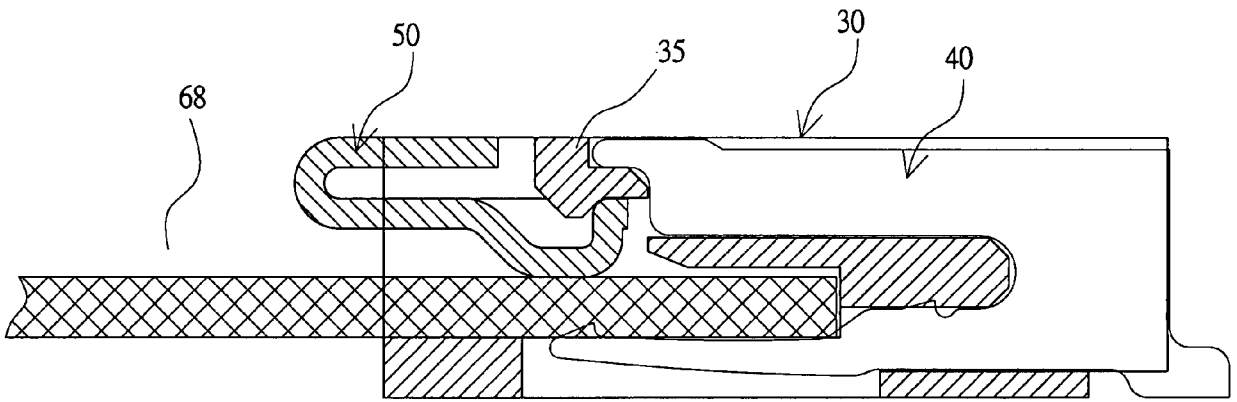

As shown in FIGS. 19 and 20, the seventh embodiment is almost the same as the fourth embodiment except that it is unnecessary to form the staggered openings and notches in the cover 50 and the pushing plate 35 of the base 30. The inclined surfaces of the cover and the pushing plate 35 of the base 30 are formed to achieve the pivoting function. In addition, the terminal 40 is assembled from the rear end to the front end of the base 30.

Figures 21, 22, 23:
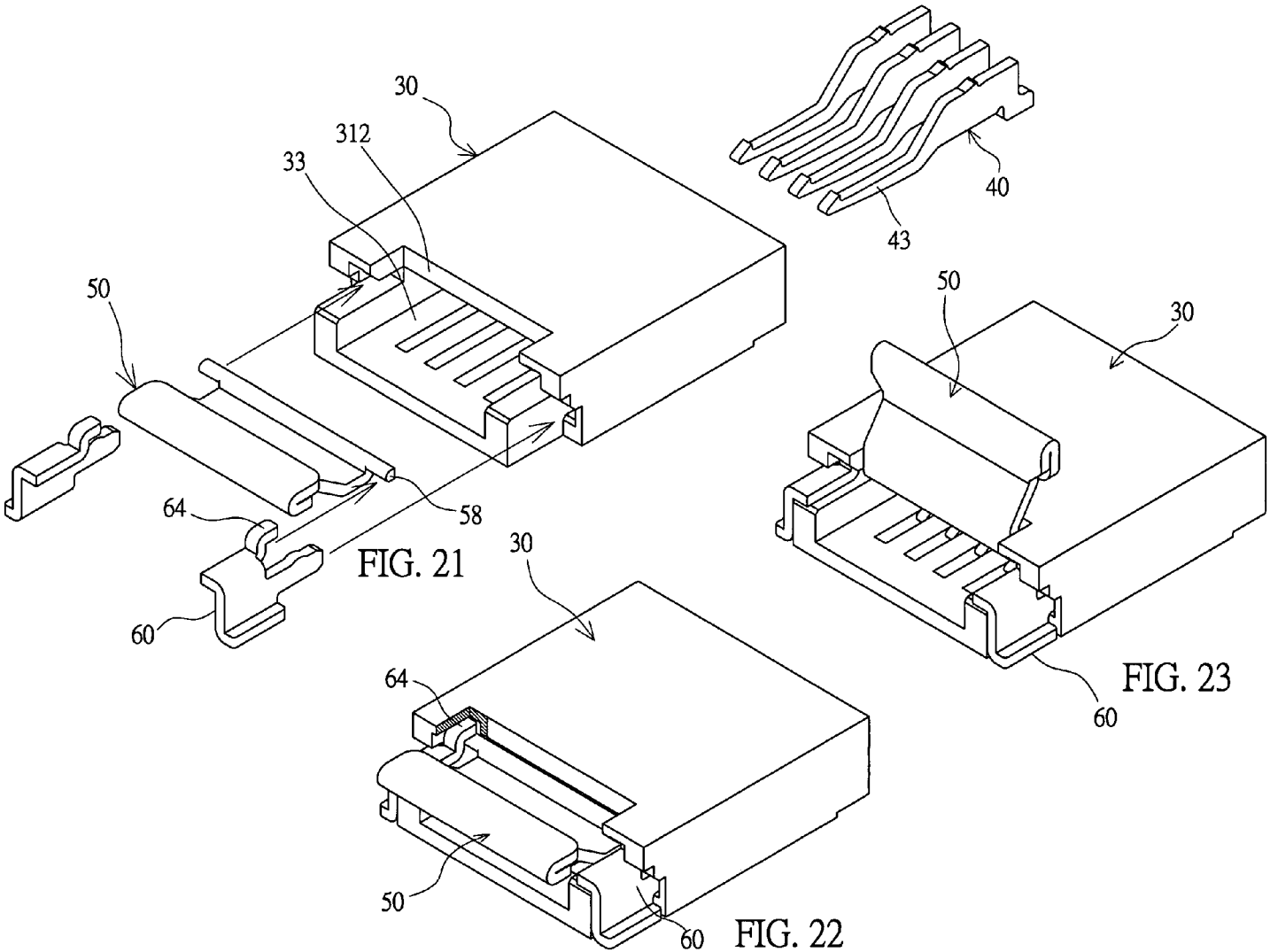
FIG. 21 is a pictorially exploded view showing an electrical connector according to an eighth embodiment of the invention.
FIGS. 22 and 23 are pictorially assembled views showing the electrical connector according to the eighth embodiment of the invention.

As shown in FIGS. 21 to 23, the eighth embodiment is almost the same as the fourth embodiment except that no pushing plate is disposed above the front end of the connection portion 33 of the base 30 but a large notch 312 is formed. The cover 50 has no opening and is attached to the front end of the connection portion 33 of the base 30. The resting plate 64 of the bonding pad 60 rests against the pivot 58 of the cover. Each terminal 40 does not have to press against the pushing plate, so the terminal 40 only has the first elastic arm 43 and may be easily manufactured with the reduced material. Although no pushing plate and no second elastic arm of the terminal press the cover 50, the cover 50 still can withstand the force of tightly pressing against the flexible circuit interface in the case when the number of terminals is small because the cover 50 is made of the metal plate and has a good rigidity and the pivots 58 at two sides are pressed by the metal bonding pads 60.

Figure 24:
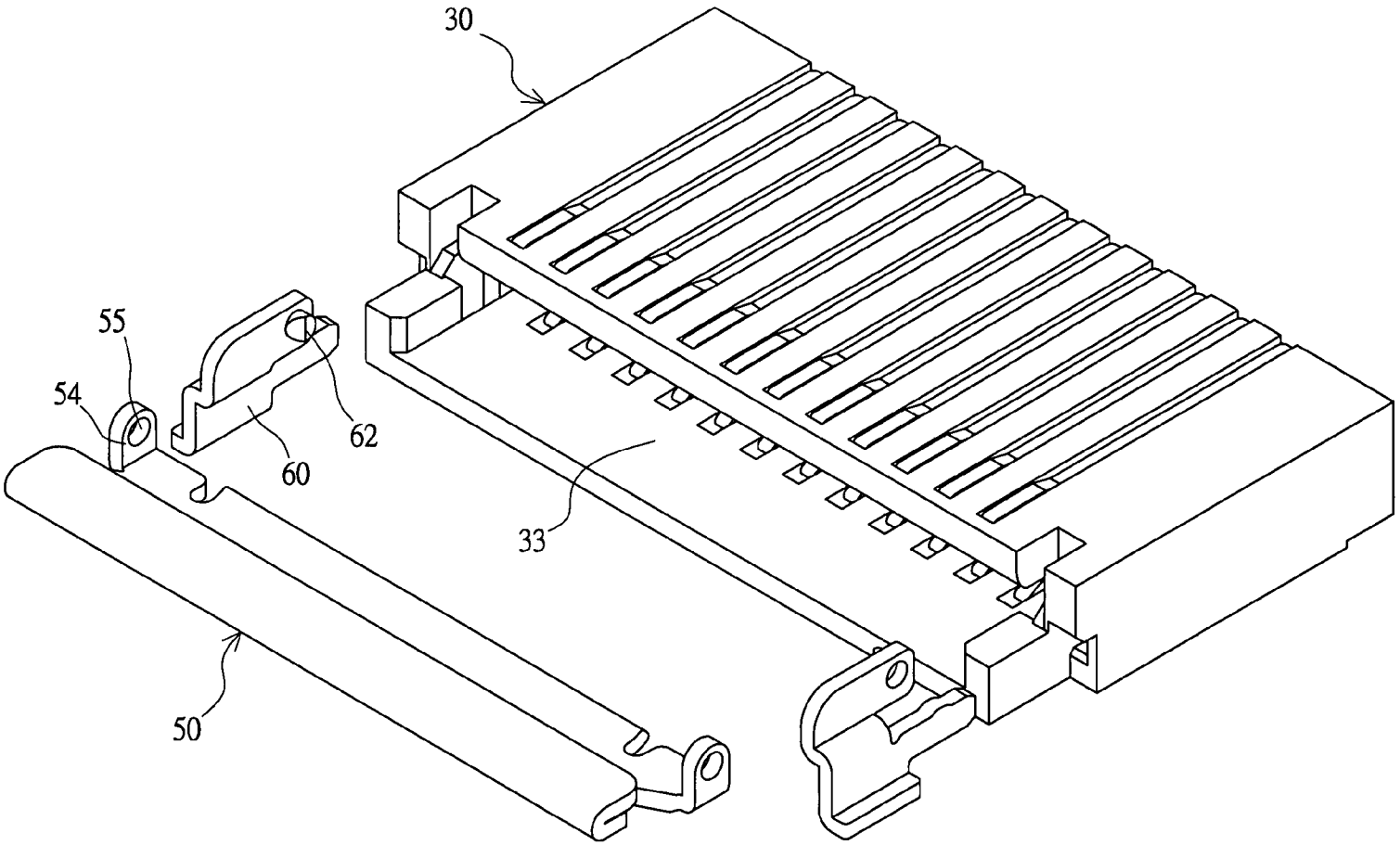
FIG. 24 is a pictorially exploded view showing an electrical connector according to a ninth embodiment of the invention.

As shown in FIG. 24, the ninth embodiment is almost the same as the first embodiment except that the inner surfaces of the bonding pads 60 of the base 30 are formed with two transversally projecting pivots 62. When the two bonding pads are fixed to two sides of the base 30, the two pivots 62 are located at two sides of the connection portion 33. Thus, the pivoting hole 55 of the pivoting lug 54 of the cover 50 may pivot onto the pivot 62. Because the bonding pad is made of the metal material, the wear resistance thereof is good and the bonding pad cannot be easily damaged by the pivoting force between the bonding pad and the cover.

Figure 25:
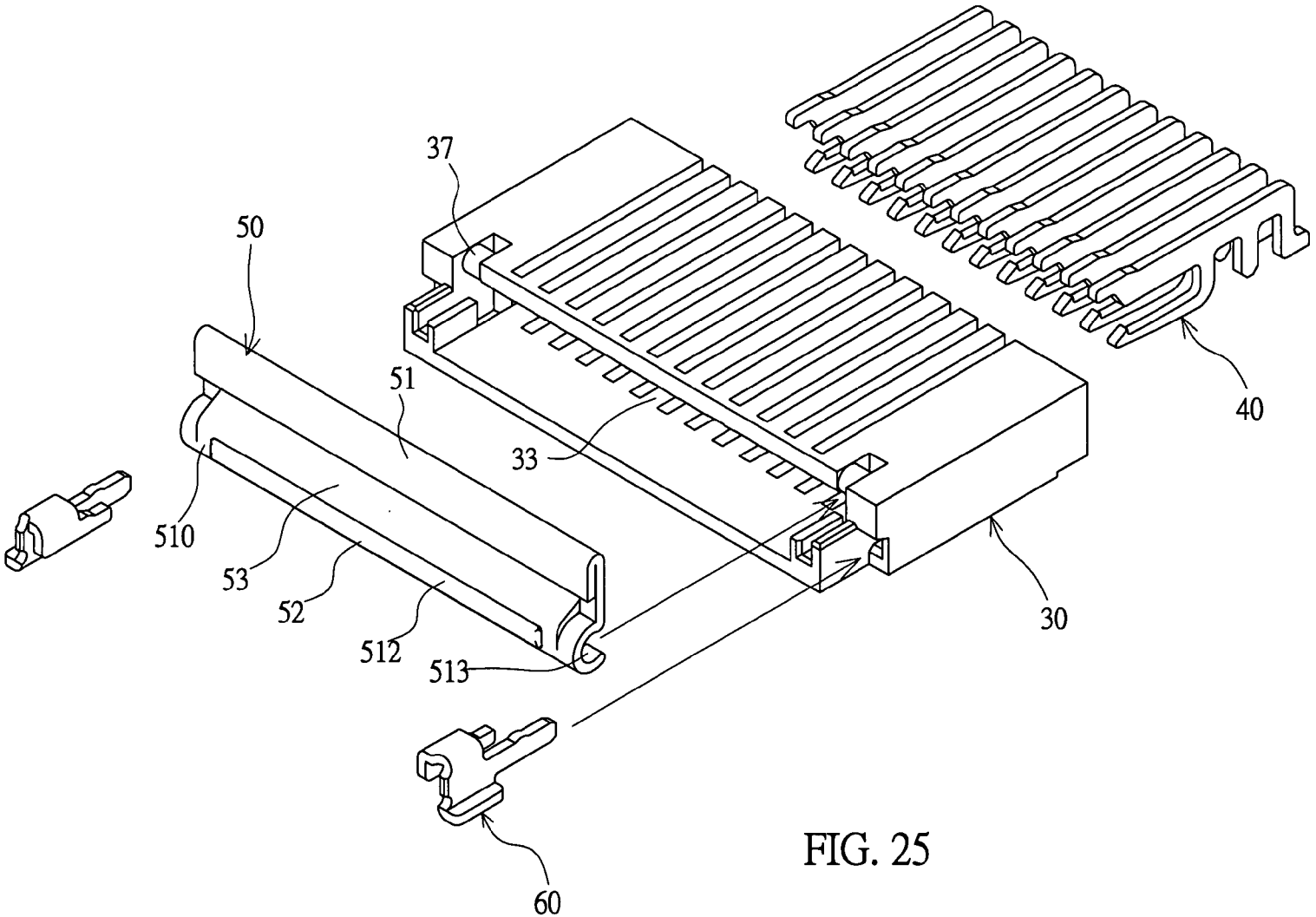
FIG. 25 is a pictorially exploded view showing an electrical connector according to a tenth embodiment of the invention.
Figure 26:
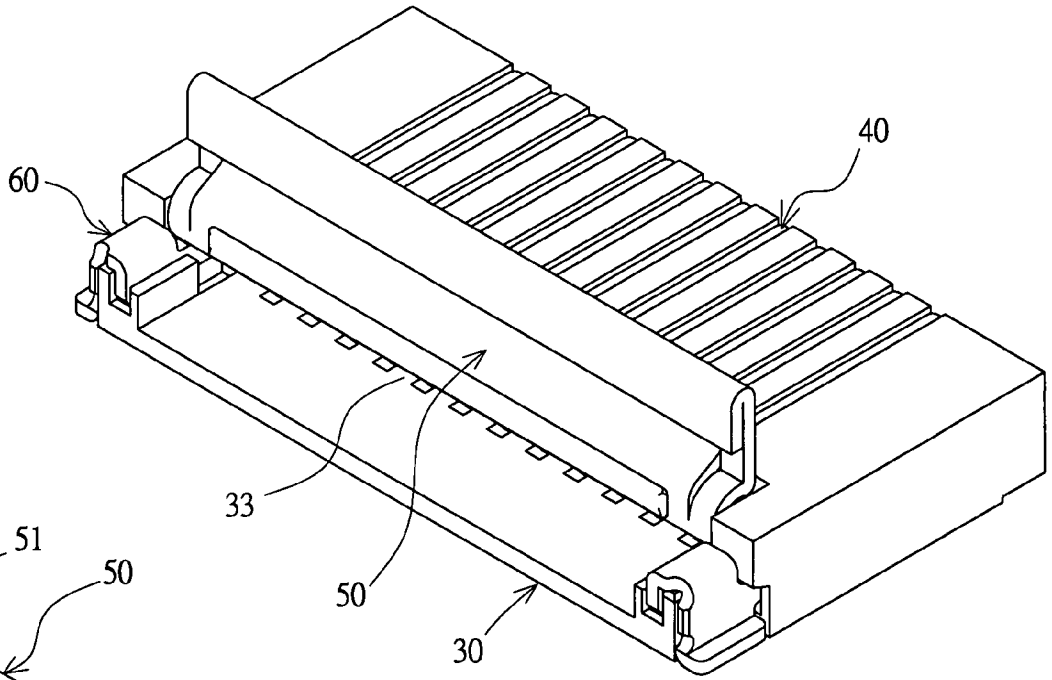
FIG. 26 is a pictorially assembled view showing the electrical connector according to the tenth embodiment of the invention.
Figure 27:
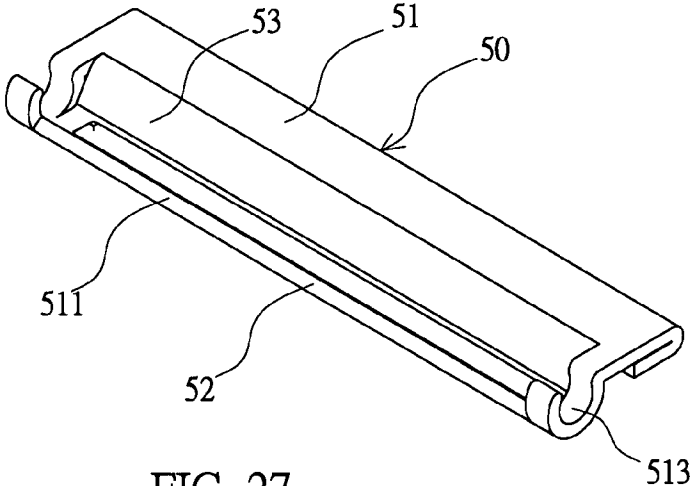
FIG. 27 is a pictorial view showing a cover according to the tenth embodiment of the invention.

As shown in FIGS. 25 to 27, the tenth embodiment of the invention is almost the same as the first embodiment except that the cover 50 of the tenth embodiment is formed by pressing and bending a metal plate. The cover 50 has a handle 51, a pressing plate 52 and two pivoting portions. An inclined extending plate 53 is disposed between the handle 51 and the pressing plate 52. The pressing plate 52 has a level board 510 and a tail end 511 extending upwards. The bottom of the level board 510 has a projection 512. Each of the two pivoting portions is formed with a pivoting recess 513, which has a circular arc surface with an arc angle of about 240 degrees, by pressing the metal plate as each of the two sides of the cover. The pivoting recesses 513 pivot to the pivots 37 at two sides of the base 30. The circular arc surface of the pivoting recess 513 covers the pivot 37 for the purpose of pivoting.

Figure 28:
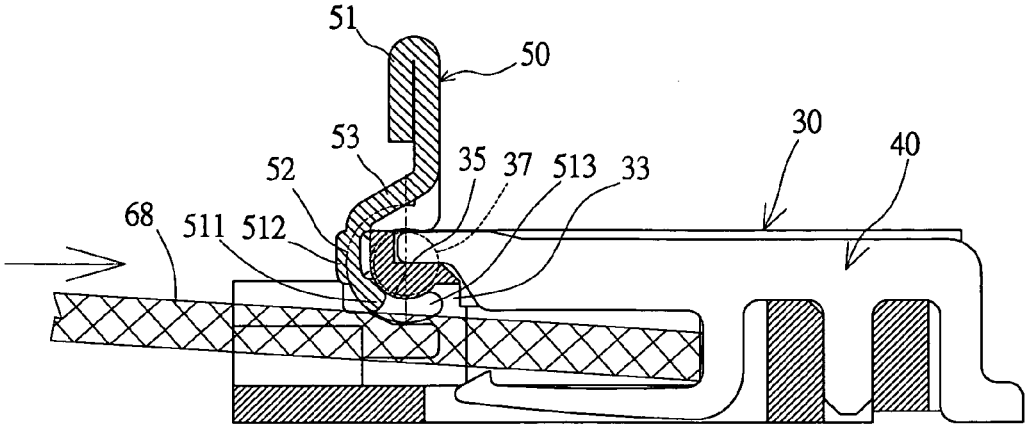
FIGS. 28 to 30 are cross-sectional side views showing usage states of the connector according to the tenth embodiment of the invention.
Figure 29:
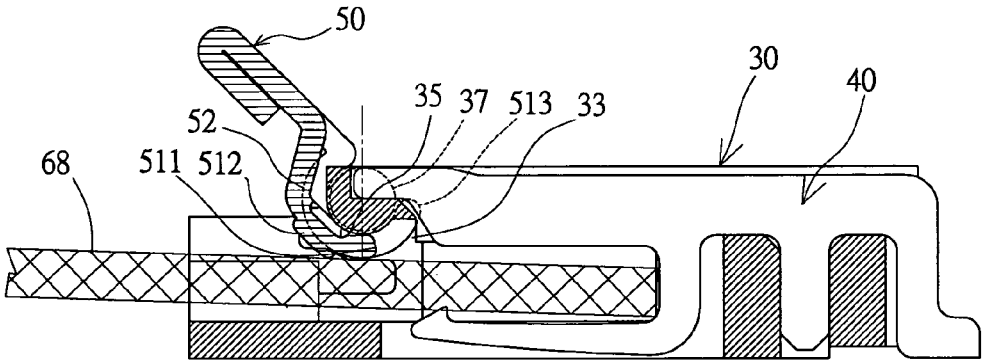
Figure 30:
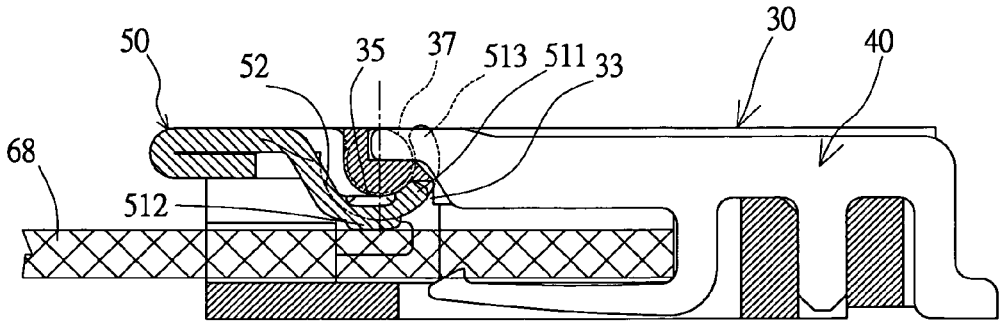

The usage states of this embodiment will be described in the following. As shown in FIG. 28, when the cover 50 is rotated upwards into a state perpendicular to the base, the pressing plate 52 is exposed out of the connection portion 33, and the flexible circuit interface 68 may be inserted in a loose state. As shown in FIG. 29, when the cover 50 is rotated downwards to form an angle of 45 degrees with the base 30, the tail end 511 of the pressing plate 52 has extended into the connection portion 33 and exceeded the vertical line passing through the center of the pivot 37. At this time, the tail end 511 only slightly contacts the flexible circuit interface 68 and the projection 512 just touches the flexible circuit interface 68 without interference. As shown in FIG. 30, when the cover 50 rotates downwards into a horizontal state relative to the base 30, the tail end 511 of the pressing plate 52 continues to rotate upwards along the circular arc surface of the pushing plate 35 into an inverse-hook state to press against and hook the circular arc surface of the pushing plate 35. The projection 512 presses and interferes with the flexible circuit interface 68 so as to fix the flexible circuit interface 68.

Each of the two pivoting portions of the cover 50 is formed with the pivoting recess 513, which has a circular arc surface with the arc angle of about 240 degrees, at two sides of the cover by pressing the metal plate. The circular arc surface of the pivoting recess 513 covers the pivot 37 to achieve the stable pivoting similar to the pivoting of a full circle without the waste of the full circle. As shown in FIG. 30, when the cover 50 is rotated into a horizontal state relative to the base 30, the pivoting recess 513 cannot cover the pivot 37 to occupy any space. Thus, the outer circumference of the pivot 37 may be flush with the top of the base 30.

Furthermore, because the pivoting recess 513 only has the ⅔ circular arc surface but not the full circular arc surface, the cover 50 and the base 30 may be easily assembled, and the manufacturing processes are simple and the cost can be reduced.

Figure 31:
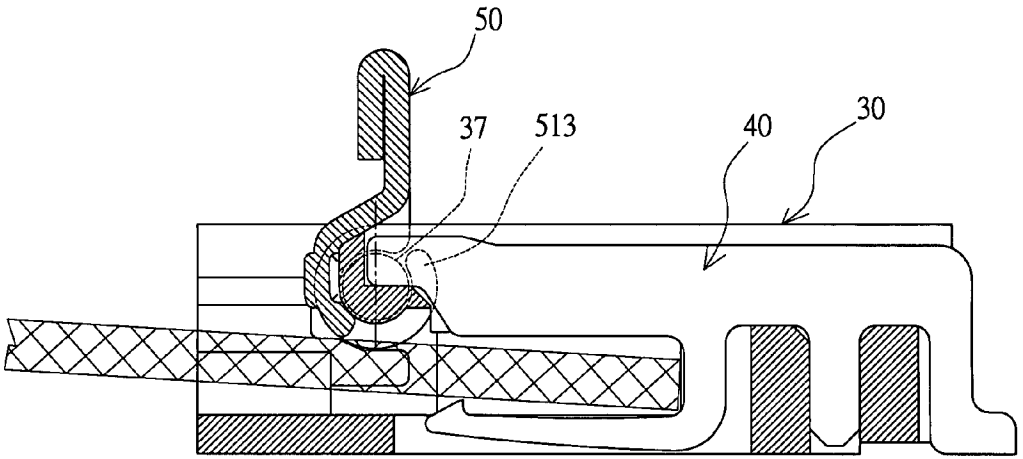
FIGS. 31 and 32 are cross-sectional side views showing usage states of a connector according to an eleventh embodiment of the invention.
Figure 32:
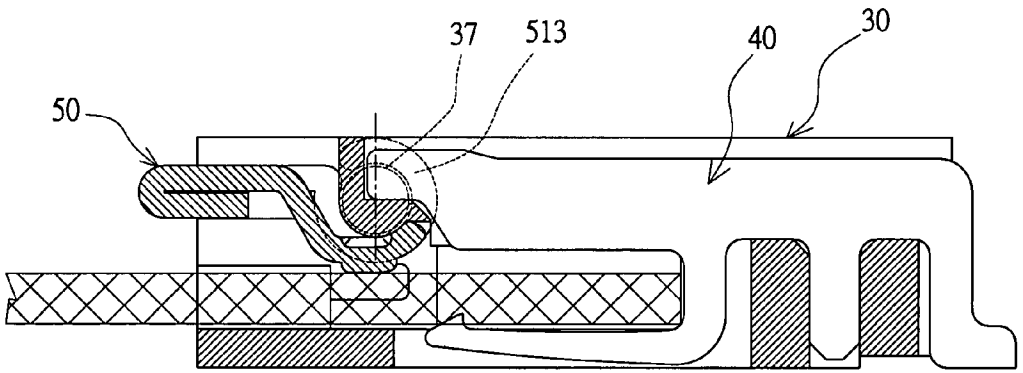

As shown in FIGS. 31 and 32, the eleventh embodiment is almost the same as the tenth embodiment except that the pivoting portion of the cover 50 of the eleventh embodiment is a pivoting recess 513 having a circular arc surface with the arc angle approximating 360 degrees. When the cover 50 is rotated downwards into a horizontal state relative to the base, the pivoting recess 513 covers the pivot to form a thickness of one plate. Thus, the pivot 37 of the base 30 of this embodiment has to be lower than the top of the base 30.

Figure 33:
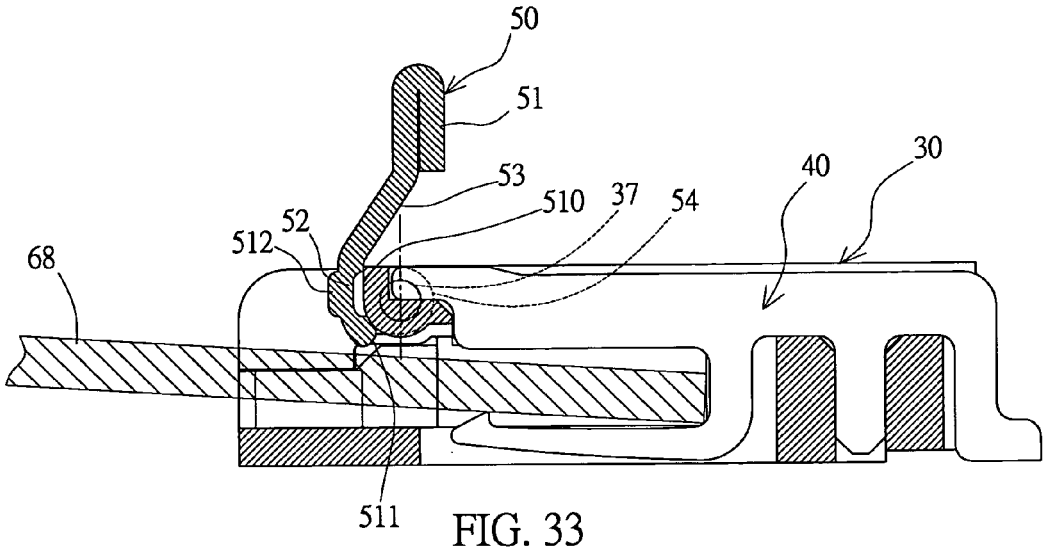
FIGS. 33 to 35 are cross-sectional side views showing usage states of a connector according to a twelfth embodiment of the invention.
Figure 34:
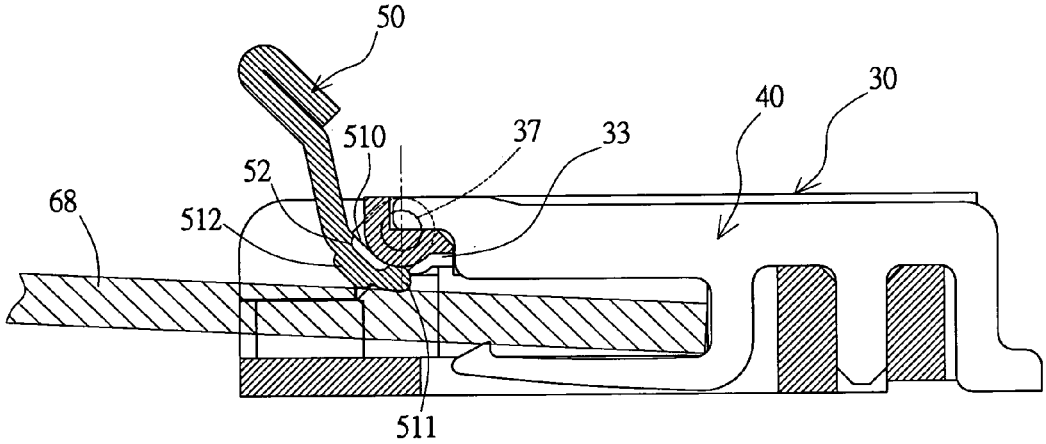
Figure 35:
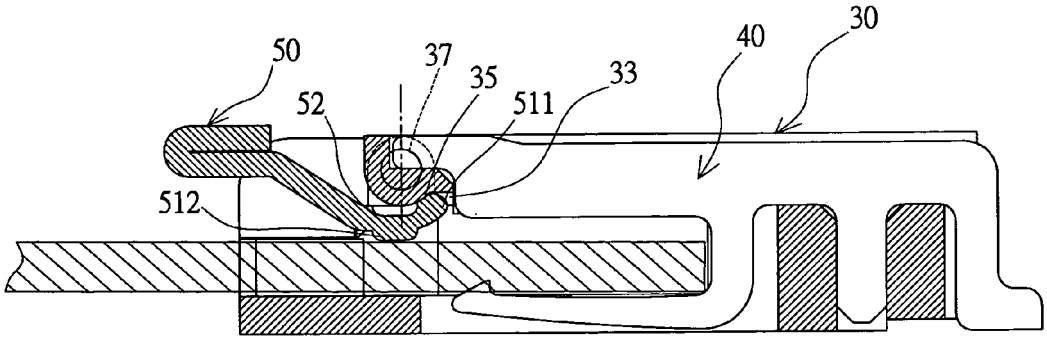

As shown in FIGS. 33 to 35, the twelfth embodiment of the invention is almost the same of the first embodiment except that the pressing plate 52 of the cover 50 of the twelfth embodiment has a level board 510 and the tail end 511 extends upwards. The bottom of the level board 510 is formed with a projection 512. As shown in FIG. 33, when the cover 50 is rotated upwards into a state perpendicular to the base 30, the pressing plate 52 is exposed out of the connection portion 33, and the flexible circuit interface 68 may be inserted in a loose state. As shown in FIG. 34, when the cover 50 is rotated downwards to form an angle of 45 degrees with the base, the tail end 511 of the pressing plate 52 has extended into the connection portion 33 and exceeded the vertical line passing through the center of the pivot 37. At this time, the tail end 511 only slightly contacts the flexible circuit interface 68 and the projection 512 just touches the flexible circuit interface 68 without any interference. As shown in FIG. 35, when the cover 50 is rotated downwards into a horizontal state relative to the base 30, the tail end 511 of the pressing plate 52 continues to rotate upwards along the circular arc surface of the pushing plate 35 into an inverse-hook state to press against and hook the circular arc surface of the pushing plate 35. The projection 512 presses and interferes with the flexible circuit interface 68 so as to fix the flexible circuit interface 68.

Figure 36:
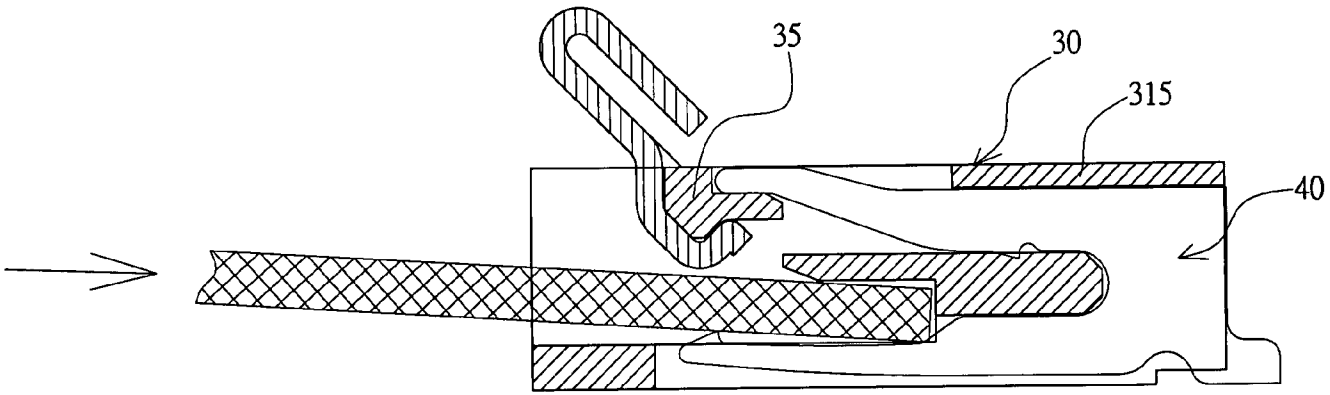
FIGS. 36 and 37 are cross-sectional side views showing usage states of a connector according to a thirteenth embodiment of the invention.
Figure 37:
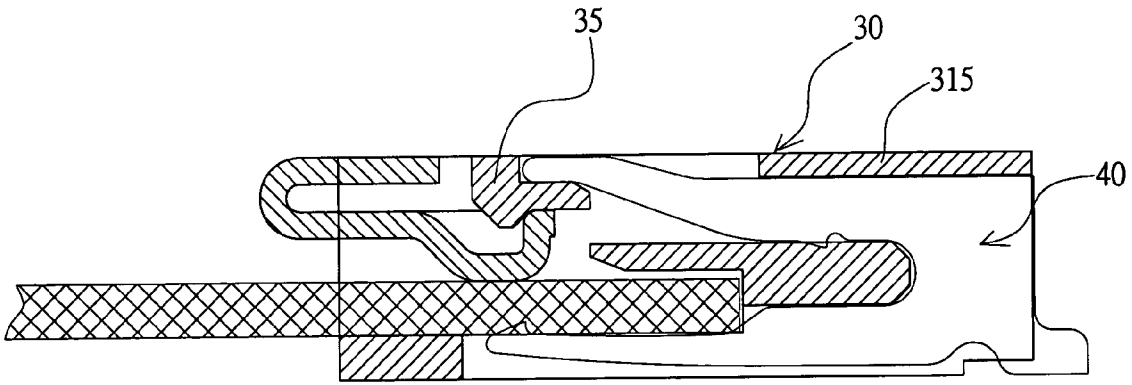

As shown in FIGS. 36 and 37, the thirteenth embodiment is almost the same as the seventh embodiment except that the rear section of the top plate surface 315 of the base 30 is closed and is not formed with spaced open slots through which the terminals 40 can pass. Although the terminals 40 cannot be easily assembled, the structure intensity of the base 30 can be enhanced.

While the invention has been described by way of examples and in terms of preferred embodiments, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. An electrical connector, comprising:

a base formed with a plurality of equally spaced terminal slots and one connection portion, the connection portion having an open end into which a flexible circuit interface may be inserted, and a pushing plate being formed above the connection portion;

a plurality of terminals disposed in the terminal slots of the base, each of the terminals having a pin portion extending out of the base, a positioning portion tightly pressing against the terminal slot of the base, a first elastic arm formed with a connection point extending to the connection portion of the base and a second elastic arm pressing the pushing plate in a direction to the flexible circuit interface, wherein the terminals are to be electrically connected to the inserted flexible circuit interface; and a cover made of a metal material and pivoted onto the base, one end of the cover extending to a location under the pushing plate when the cover is rotated downwards, wherein the pushing plate presses down the cover to tightly presses against the flexible circuit interface to electrically connect the flexible circuit interface to the connection points of the terminals.

2. The connector according to claim 1, wherein the pushing plate is formed with a pivoting portion, and the one end of the cover is formed with an eccentric plate engaging with and pivoting onto the pivoting portion of the pushing plate.

3. The connector according to claim 1, wherein the other end of the cover is bent to form a handle.

4. The connector according to claim 1, wherein pivots to be pivoted onto two sides of the base are formed at two sides of the cover.

5. The connector according to claim 4, wherein metal bonding pads are formed at the two sides of the base, and each of the bonding pads is formed with a resting plate resting against the pivot of the cover.

6. An electrical connector, comprising:

a base formed with a plurality of equally spaced terminal slots and one connection portion, the connection portion having an open end into which a flexible circuit interface may be inserted from a front side to a back side, and a pushing plate formed with a pivoting portion being formed above the connection portion;

a plurality of terminals disposed in the terminal slots of the base, each of the terminals having a pin portion extending out of the base, a positioning portion tightly pressing against the terminal slot of the base, and a first elastic arm formed with a connection point extending to the connection portion of the base, wherein the terminals are to be electrically connected to the inserted flexible circuit interface; and a cover having one end formed with an eccentric plate extending into the connection portion of the base, wherein the pushing plate is in front of the connection points of the terminals, the pushing plate pushes the cover in a direction to the flexible circuit interface, the eccentric plate engages with and pivots onto the pivoting portion of the pushing plate of the base, and the eccentric plate tightly presses against the flexible circuit interface to electrically connect the flexible circuit interface to the connection points of the terminals.

7. The connector according to claim 6, wherein each of the terminals further has a second elastic arm for pressing the pushing plate in the direction to the flexible circuit interface.

8. The connector according to claim 6, wherein spaced open slots corresponding to the terminal slots are formed on a top plate surface of the base in back of the pushing plate such that the terminals pass through the open slots when the terminals are assembled in the base.

9. The connector according to claim 6, wherein the cover is made of a metal material and the eccentric plate has an L shape.

10. The connector according to claim 6, wherein pivots to be pivoted onto two sides of the base are formed at two sides of the cover.

11. The connector according to claim 10, wherein metal bonding pads are formed at the two sides of the base, and each of the bonding pads is formed with a resting plate resting against the pivot of the cover.

12. An electrical connector, comprising:

a base formed with a plurality of equally spaced terminal slots and one connection portion, the connection portion having an open end into which a flexible circuit interface may be inserted from a front side to a back side, and a pushing plate being formed above the connection portion;

a plurality of terminals disposed in the terminal slots of the base, each of the terminals having a pin portion extending out of the base, a positioning portion tightly pressing against the terminal slot of the base, and a first elastic arm formed with a connection point extending to the connection portion of the base, wherein the terminals are to be electrically connected to the inserted flexible circuit interface; and a cover made of a metal material, wherein the pushing plate is in front of the connection points of the terminals, the pushing plate pushes the cover in a direction to the flexible circuit interface, the cover has a handle and a pressing plate, two sides of the cover are formed with projecting pivoting portions pivoting onto two sides of the connection portion of the base, the pressing plate may extend into the connection portion to tightly press against and be located between the pushing plate and the flexible circuit interface when the cover is rotated downwards, and the pressing plate is exposed out of the connection portion to make the pushing plate and the flexible circuit interface loose when the cover is lifted upwards.

13. The connector according to claim 12, wherein each of the terminals further has a second elastic arm for pressing the pushing plate in the direction to the flexible circuit interface.

14. The connector according to claim 12, wherein spaced open slots corresponding to the terminal slots are formed on a top plate surface of the base in back of the pushing plate such that the terminals pass through the open slots when the terminals are assembled in the base.

15. The connector according to claim 12, wherein metal bonding pads are formed at two sides of the base, and each of the bonding pads has a pivoting portion pivoting onto the pivoting portion of the cover.

16. The connector according to claim 12, wherein the other end of the cover is folded back to form a handle.

17. The connector according to claim 12, wherein the cover is formed by pressing a metal plate, and the pivoting portion comprises pivoting lugs, which are bent upwards at two sides of the pressing plate.

18. The connector according to claim 17, wherein the pressing plate of the cover has a level board and a tail end extending upwards, a bottom of the level board is formed with a projection, which tightly presses against and is located between the pushing plate and the flexible circuit interface, and the tail end of the pressing plate exceeds a vertical line passing through a center of the pivot to hook the pushing plate of the base.

19. The connector according to claim 17, wherein pivots are formed at the two sides of the connection portion of the base, and the pivoting lugs of the cover are formed with pivoting holes pivoting onto the pivots.

20. The connector according to claim 19, wherein the pushing plate of the base has a circular arc surface concentric with the pivots.

21. The connector according to claim 12, wherein pivots are formed at the two sides of the connection portion of the base, the cover is formed by pressing a metal plate, the pivoting portion is formed with a pivoting recess, which has a circular arc surface having an arc angle greater than 180 degrees, by pressing the metal plate, the pivoting recess pivots onto the pivot, and the circular arc surface of the pivoting recess covers the pivot.

22. The connector according to claim 21, wherein the pressing plate of the cover has a level board and a tail end extending upwards, a bottom of the level board is formed with a projection, which tightly presses against and is located between the pushing plate and the flexible circuit interface, and the tail end of the pressing plate exceeds a vertical line passing through a center of the pivot to hook the pushing plate of the base.

23. The connector according to claim 21, wherein the pushing plate of the base has a circular arc surface concentric with the pivots.

* * * * *